US007383186B2

(12) United States Patent
Kemmochi

(10) Patent No.: US 7,383,186 B2
(45) Date of Patent: Jun. 3, 2008

(54) SINGING VOICE SYNTHESIZING APPARATUS WITH SELECTIVE USE OF TEMPLATES FOR ATTACK AND NON-ATTACK NOTES

(75) Inventor: Hideki Kemmochi, Shizuoka (JP)

(73) Assignee: Yamaha Corporation (JP)

( * ) Notice: Subject to any disclaimer, the term of this patent is extended or adjusted under 35 U.S.C. 154(b) by 774 days.

(21) Appl. No.: 10/792,265

(22) Filed: Mar. 3, 2004

(65) Prior Publication Data

US 2004/0186720 A1 Sep. 23, 2004

(30) Foreign Application Priority Data

Mar. 3, 2003 (JP) ..... 2003-055898

(51) Int. Cl.
*G10L 19/00* (2006.01)

(52) U.S. Cl. ..... 704/260; 704/258; 84/681; 84/691

(58) Field of Classification Search ..... 704/260, 704/258; 84/681, 692
See application file for complete search history.

(56) References Cited

U.S. PATENT DOCUMENTS 7,135,636 B2 * 11/2006 Kemmochi et al. ..... 84/622
7,191,105 B2 * 3/2007 Holzrichter et al. ..... 703/2
2002/0184032 A1 * 12/2002 Hisaminato et al. ..... 704/268
2003/0009344 A1 1/2003 Kayama et al.

FOREIGN PATENT DOCUMENTS

EP 1 220 194 A2 12/2001
EP 1 239 457 A2 9/2002
EP 1 239 463 A2 9/2002
JP 2002-268659 A 9/2002

OTHER PUBLICATIONS

Relevant portion of Japanese Office Action of corresponding Japanese Application 2003-055898.

* cited by examiner

*Primary Examiner*—Daniel Abebe
(74) *Attorney, Agent, or Firm*—Rossi, Kimms & McDowell LLP

(57) ABSTRACT

In an apparatus for synthesizing a singing voice of a song, a storage section stores template data in correspondence to various expressions applicable to music notes. The template data includes first and second template data differently defining a temporal variation of a characteristic parameter for applying the corresponding expression to an attack note and a non-attack note, respectively. An input section inputs voice information representing a sequence of vocal elements and specifying expressions in correspondence to the respective vocal elements. A synthesizing section synthesizes the singing voice from the sequence of the vocal elements based on the inputted voice information. When the vocal element is of an attack note, the first template data is applied to the vocal element. Otherwise, when the vocal element is of a non-attack note, the second template data is applied to the vocal element.

16 Claims, 12 Drawing Sheets

FIG.3

| VOCAL ELEMENT NAME | TYPICAL PITCH | TEMPLATE |
|---|---|---|
| /A/ | 200 | {P (t),Pitch (t),T) } |
| /A/ | 300 | {P (t),Pitch (t),T) } |
| /A/ | 400 | {P (t),Pitch (t),T) } |
| /I/ | 200 | {P (t),Pitch (t),T) } |
| /I/ | 300 | {P (t),Pitch (t),T) } |
| ⋮ | ⋮ | ⋮ |

FIG.4

| LEADING VOCAL ELEMENT NAME | FOLLOWING VOCAL ELEMENT NAME | TYPICAL PITCH | TEMPLATE |
|---|---|---|---|
| /A/ | /A/ | 200 | {P (t),Pitch (t),T) } |
| /A/ | /A/ | 300 | {P (t),Pitch (t),T) } |
| /A/ | /A/ | 400 | {P (t),Pitch (t),T) } |
| /A/ | /I/ | 200 | {P (t),Pitch (t),T) } |
| /A/ | /I/ | 300 | {P (t),Pitch (t),T) } |
| ⋮ | ⋮ | ⋮ | ⋮ |

SINGING VOICE SYNTHESIZING APPARATUS WITH SELECTIVE USE OF TEMPLATES FOR ATTACK AND NON-ATTACK NOTES

BACKGROUND OF THE INVENTION

1. Technical Field of the Invention

The present invention is related to a singing voice synthesizing apparatus and, more particularly, to a singing voice synthesizing apparatus for synthesizing naturally sounding singing tones applied with suitable expression.

2. Related Art

Technologies are known in which a variety of parameters obtained by analyzing actually uttered voices are prepared and these parameters are combined to synthesize singing voices. One of these technologies is disclosed in Japanese Published Unexamined Patent Application No. 2002-268659 (refer to patent document 1).

Patent document 1 discloses the following technology. First, a database is prepared in which the parameters characterizing the formants of vocal elements are stored, and another database is also prepared in which template data for imparting time-sequential changes to these parameters are stored.

Also prepared beforehand are music score data having a vocal element track for specifying the vocal elements of lyrics in a time-sequential manner, a musical note track for specifying a song starting point and musical note transition points, a pitch track for specifying pitches of the vocal elements, a dynamics track for specifying a vocal intensity at each specified time, and an opening track for specifying a lip opening degree at each specified time.

In performance, the parameters are read from the tracks in the stored data and the above-mentioned template data are applied to these parameters to obtain the final parameters having minute changes for each time, thereby executing vocal synthesis of singing voice on the basis of these final parameters.

The types of the parameters and the templates to be prepared for the vocal synthesis are diverse. The preparation of these various types of parameters and templates allows the sophisticated synthesis of the singing voice which are diversified and resemble to natural human vocalization.

Patent document 1 is Japanese Published Unexamined Patent Application No. 2002-268659.

One type of the templates is desirably prepared for the synthesis of singing voices which are diverse and close to human vocalization, that is a template associated with expressions such as accent and portamento, for example. Variation pattern of formant and pitch of each vocal element depends on whether the expression is applied to the singing voice or not as well as the types of expression. Therefore, the synthesis of singing voices which are more diverse might be realized by preparing templates corresponding to different expressions and applying a template specified by a user to a desired part of the song.

However, the above-mentioned realization of the vocal synthesis with different expressions involves problems to be solved. For example, for the singing with an expression of the same type, the variation pattern of the formant and pitch of the vocal element depends on whether or not the music notes to which the expression is applied is preceded by contiguous musical notes. Thus, no proper and natural way of singing may be reproduced, unless different template data are applied selectably to one case where the music note to which the expression is applied is preceded by contiguous musical notes and another case where the music note is not preceded by contiguous musical notes.

It may be possible to prepare two different template data for one case where the music note to which the expression is applied is preceded by contiguous musical notes and another case where the music note is not preceded by contiguous musical notes, by analyzing each of the voices of attack and non-attack notes actually sung under these conditions. It should be noted that there do not exist so far such different templates for attack note and non-attack note. Even if such templates are created, however, this requires users who create song data to undertake a time and labor consuming task of making allocation of the two different template data to each vocal element on a case-by-case basis in order to impart the suitable and adequate expression to each vocal element.

SUMMARY OF THE INVENTION

It is therefore an object of the present invention to provide a singing voice synthesizing apparatus operative, when imparting expressions to particular sections of a song, for allowing users who create song data to apply proper expression templates without having to be aware of whether each of these sections is preceded by any contiguous musical notes or not.

In carrying out the invention and according to one aspect thereof, there is provided an apparatus for synthesizing a singing voice of a song, comprising a storage section that stores template data in correspondence to various expressions applicable to music notes including an attack note and a non-attack note, the template data including first template data defining a temporal variation of a characteristic parameter for applying the corresponding expression to the attack note and second template data defining a temporal variation of a characteristic parameter for applying the corresponding expression to the non-attack note, an input section that inputs voice information representing a sequence of vocal elements forming lyrics of the song and specifying expressions in correspondence to the respective vocal elements, and a synthesizing section that synthesizes the singing voice of the lyrics from the sequence of the vocal elements based on the inputted voice information, such that the synthesizing section operates when the vocal element is of an attack note for retrieving the first template data corresponding to the expression specified to the vocal element and applying the specified expression to the vocal element of the attack note according to the retrieved first template data, and operates when the vocal element is of a non-attack note for retrieving the second template data corresponding to the expression specified to the vocal element and applying the specified expression to the vocal element of the non-attack note according to the retrieved second template data. It should be noted that "attack note" herein denotes a vocal element which is located at a start point where an attack transition takes place from a silent state where no singing is made to a state where singing is commenced.

In a form, the synthesizing section includes a discriminating subsection that discriminates each vocal element to either of the non-attack note or the attack note based on the inputted voice information in real time basis during the course of synthesizing the singing voice of the song.

Preferably, in the above-mentioned singing voice synthesizing apparatus, the input section inputs the voice information containing timing information which specifies utterance timings of the respective vocal elements along a progression of the song, and the synthesizing section includes a discriminating subsection that discriminates the respective vocal elements to either of the non-attack note or the attack note based on the utterance timings of the respective vocal elements, such that the vocal element is identified to the non-attack note when the vocal element has a preceding vocal element which is uttered before the vocal element and when a difference of the utterance timings between the vocal element and the preceding vocal element is within a predetermined time length, and otherwise the vocal element is identified to the attack note when the vocal element has no preceding vocal element or has a preceding vocal element but the difference of utterance timings between the vocal element and the preceding vocal element exceeds the predetermined time length.

Practically, the input section inputs the voice information in the form of a vocal element track and an expression track, the vocal element track recording the vocal elements integrally with the timing information such that the respective vocal elements are sequentially arranged along the vocal element track in a temporal order determined by the respective utterance timings, the expression track recording the expressions corresponding to the vocal elements in synchronization with the vocal element track.

Otherwise, the input section inputs the voice information containing pitch information which represents a transition of a pitch applied to each vocal element in association with an utterance timing of each vocal element, and the synthesizing section includes a discriminating subsection that discriminates each vocal element to either of the non-attack note or the attack note based on the pith information, such that the vocal element is identified to the non-attack note when a value of the pitch is found in a preceding time slot extending back from the utterance timing of the vocal element by a predetermined time length, and otherwise the vocal element is identified to the attack note when a value of the pitch lacks in the preceding time slot.

Practically, the input section inputs the voice information in the form of a vocal element track, a pitch track and an expression track, the vocal element track recording the sequence of the respective vocal elements in a temporal order determined by the respective utterance timings, the pitch track recording the transition of the pitch applied to each vocal element in synchronization with the vocal element track, the expression track recording the expressions corresponding to the vocal elements in synchronization with the vocal element track.

BRIEF DESCRIPTION OF THE DRAWINGS

FIG. 3 is an example of the data structure of a template database.

FIG. 4 is an example of the data structure of another template database.

DETAILED DESCRIPTION OF THE INVENTION

A: The First Embodiment

This invention will be described in further detail by way of a first embodiment with reference to the accompanying drawings. The first embodiment is characterized by that the context of a top or leading vocal element in a section specified to be sung with an expression is determined and the proper expression template data which correspond to the type of the determined context are applied to that section.

Template data defines a pattern by which prameters characterizing the singing voice are to be changed with time. The details of the template data will be described later. The "context" denotes the positional relationship of a target vocal element relative to adjacent vocal elements to be uttered precedingly. The context used in the first embodiment denotes either of a note attack and a note transition. The note attack denotes a position of the vocal element at which the singing starts from the silent state where no vocalization is performed. The note transition denotes a position of the vocal element where no note attack is taking place; namely, a position where vocalization shifts from a preceding vocal element to a following vocal element.

When a particular section of the song is sung with a particular expression, even if an expression of the same type applies, articulation of the singing depends on whether the leading vocal element of this section is positioned a note attack or a note transition. In order to properly reproduce such a fine difference in the articulation of the singing, the first embodiment automatically selects proper template data in accordance with the context of the top vocal element of the section to which an expression is imparted, and applies the selected template data to the section by executing an operation to be described later.

The definition of "vocal element" as used herein is as follows. In the present embodiment, the vocal element denotes a phoneme or a set of phonemes (equivalent to a syllable) which can be uttered with a pitch. To be more specific, a set of phonemes in which the phoneme of a consonant and the phoneme of the following vowel are coupled (for example, syllable "ka") or a phoneme consisting of only a vowel (for example, syllable "a") is defined as one "vocal element."

<Configuration of the First Embodiment>

Figure 1:
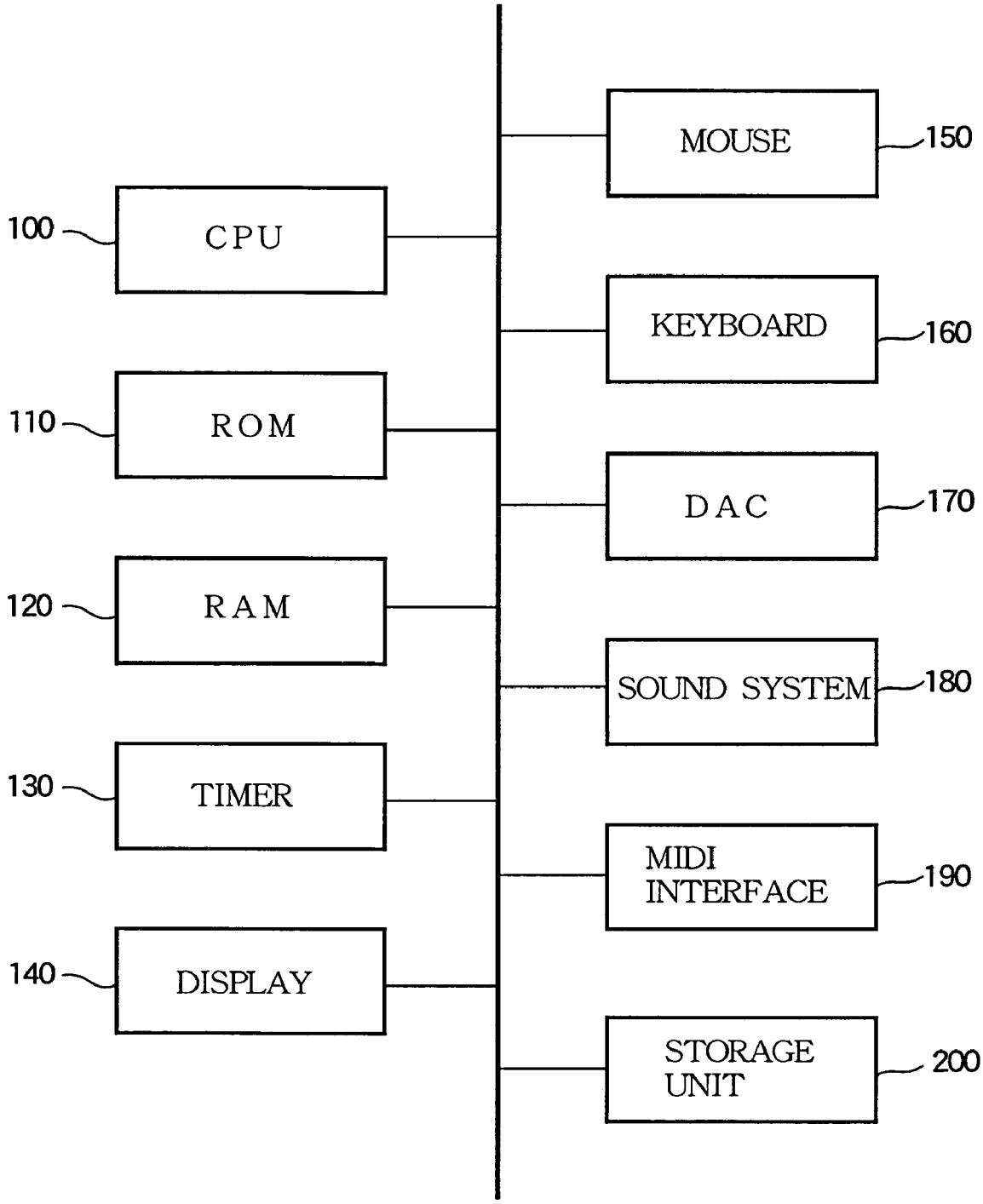
FIG. 1 is a block diagram illustrating a physical configuration of a singing voice synthesizing apparatus.

FIG. 1 is a block diagram illustrating a physical configuration of a singing voice synthesizing apparatus practiced as the first embodiment of the invention. As shown, the singing voice synthesizing apparatus has a CPU 100, a ROM 110, a RAM 120, a timer 130, a display 140, a mouse 150, a keyboard 160, a DAC (D/A converter) 170, a sound system 180, a MIDI interface 190, a storage unit 200, and a bus. It should be noted that the interfaces for the display 140, the mouse 150, the keyboard 160, and the storage unit 200 are not shown.

The storage unit 200 is a hard disk drive (HDD) for example in which an OS (Operating System) and various application programs are stored. It should be noted that the storage unit 200 may alternatively be a CD-ROM unit, a magneto-optical disk (MO) unit, or a digital versatile disk (DVD) unit, for example. The CPU 100 executes the OS (Operating System) installed in the storage unit 200 for example and provides, to the user, so-called GUI (Graphical User's Interface) based on the display information provided by the display 140 and the operation with the mouse 150. Also, the CPU 100 receives the instructions for the execution of application programs from the user through the GUI and executes the specified application programs by reading them from the storage unit 200. The application programs stored in the storage unit 200 include a singing voice synthesizing program. This singing voice synthesizing program causes the CPU 100 to execute operations unique to the present embodiment. The RAM 120 is used as a work area for the execution of this program.

The MIDI interface 190 has capabilities of receiving song data from other MIDI devices and outputting song data to the MIDI device.

Figure 2:
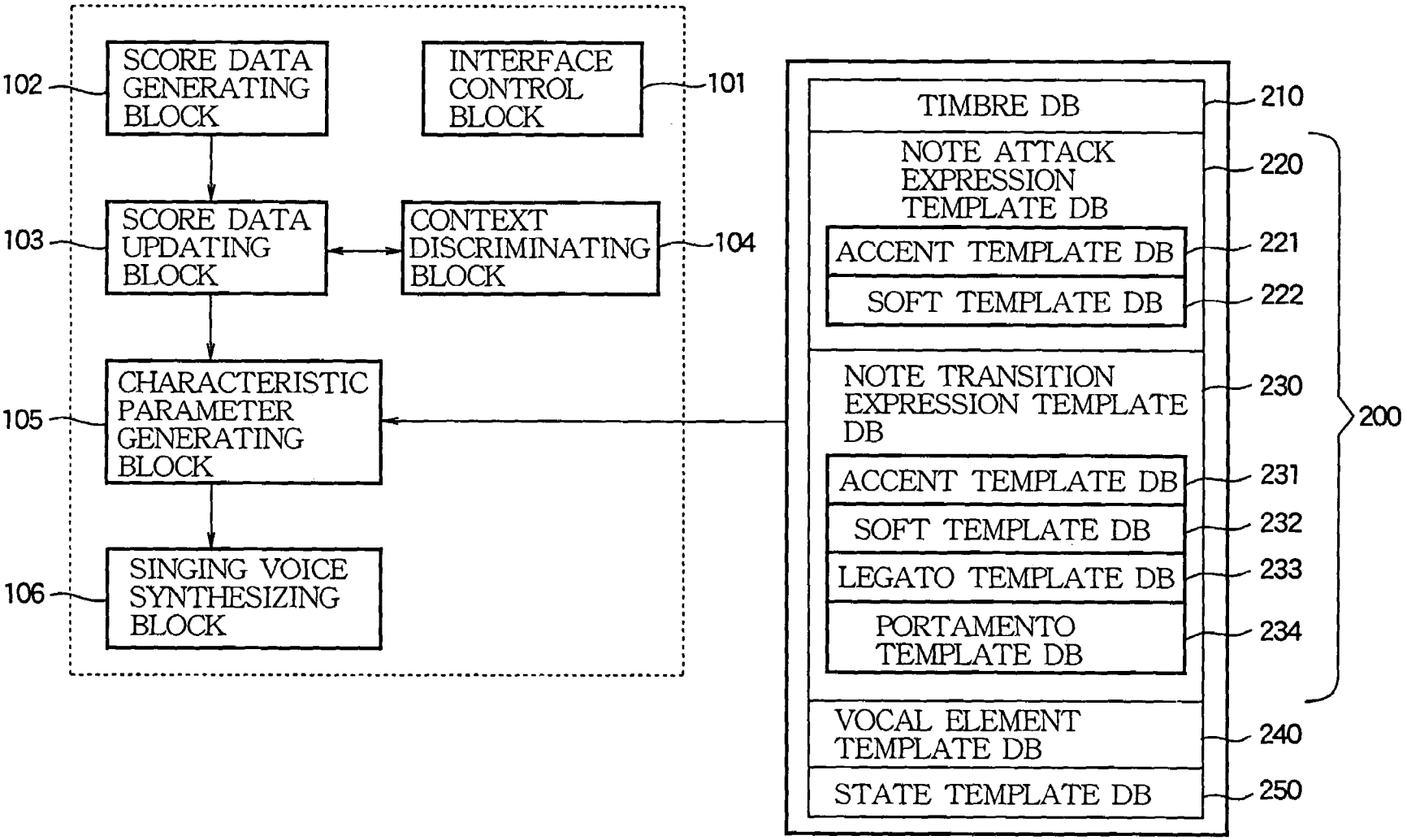
FIG. 2 is a block diagram illustrating a logical configuration of the above-mentioned singing voice synthesizing apparatus.

FIG. 2 is a block diagram illustrating a logical configuration of the singing voice synthesizing apparatus practiced as the first embodiment of the invention. On the left side of the figure, a configuration of the component blocks under the control of the CPU 100 is shown; on the right side of the figure, a configuration of databases organized into the storage unit 200 is shown.

First, executing the singing voice synthesizing program installed in the storage unit 200, the CPU 100 carries out the roles of an interface control block 101, a score data generating block 102, a context discriminating block 104, a score data updating block 103, a characteristic parameter generating block 105, and a singing voice synthesizing block 106.

The interface control block 101 controls a song data edit screen shown on the display 140. Referencing this song data edit screen, the user enters data necessary for editing song score data. The song score data are song data representing, in a plurality of tracks, phrases of singing sounds which change with time. It should be noted that the details of the configuration of this song data edit screen and the song store data will be described later.

The score data generating block 102 generates song score data by use of the data entered by the user. The context discriminating block 104 discriminates the context of each vocal element represented by the above-mentioned song score data. The score data updating block 103 adds context data to the above-mentioned song score data on the basis of a result of the discrimination executed by the context discriminating block 104. The context data identify whether each vocal element represented by the song. score data denotes a note attack note or a note transition tone.

The characteristic parameter generating block 105 generates the characteristic parameters of each singing tone to be generated on the basis of song score data and context data and supplies the generated characteristic parameters to the singing voice synthesizing block 106. The characteristic parameters may be divided into four parameters; excited waveform spectrum envelope, excited resonance, formant, and differential spectrum. These four characteristic parameters are obtained by resolving the harmonics spectral envelopes (original spectra) obtained by analyzing actual human voices (original human voices) for example.

The singing voice synthesizing block 106 synthesizes the value recorded to each track of song score data and the above-mentioned characteristic parameters into a digital music tone.

The following describes the various databases shown on the right side of FIG. 2. Timbre database 210 stores vocal element names and characteristic parameters having different pitches. A voice at a certain time can be represented by characteristic parameters (a set of excited spectrum, excited resonance, formant, and differential spectrum) and the same voice has different characteristic parameters if it has different pitches. The timbre database 210 has vocal element names and pitches as its index. Therefore, the CPU 100 can read the characteristic parameters at certain time t1 by use of the data belonging to the vocal element track and pitch track of the above-mentioned song score data, as a search key.

A expression template database 200 stores template data for use in imparting expressions to vocal elements. In the present embodiment, the expressions to be imparted to vocal elements include accent, soft, legato, and portamento. In the present embodiment, in order to impart these expressions to vocal elements, the characteristic parameters and pitches of the voice waveform corresponding to each vocal element are changed with time. As described above, the template data define in which mode the parameters characterizing each singing sound are to be changed with time; "parameters characterizing each singing sound" as used herein are characteristic parameter P and pitches, to be specific. The template data in the present embodiment are configured by a combination of a sequence of digital values obtained by sampling the characteristic parameter P and pitch "Pitch" represented as a function of time t by constant time Δt interval and section length T (sec.) of characteristic parameter P and pitch "Pitch" and may be expressed in the following equation (A).

[Equation 1]

$$\text{Template}=[P(b),\ \text{Pitch}(t),\ T] \tag{A}$$

wherein, t=0, Δt, 2Δt, 3Δt, . . . T, Δt being 5 ms in the present embodiment. As Δt is decreased, time resolution gets better, which in turn improves sound quality but at the cost of the increased size of the database. Conversely, as Δt is increased, sound quality deteriorates but with the reduced size of the database. Therefore, Δt may be determined by considering sound quality of database size.

The expression template database 200 is divided into a note attack expression template database 220 and a note transition expression template database 230.

The note attack expression template database 220 stores the template data for use in imparting expressions to a section beginning with a note attack note. This note attack expression template database 220 is divided into a accent template database 221 and a soft template database 222 in accordance with the types of expression imparting. For each of the template databases in the note attack expression template database 220, template data are prepared in which focal sound names and typical pitches form an index as shown in FIG. 3 for all combinations of a plurality of vocal elements and a plurality of typical pitches which are assumed beforehand. It should be noted that, as shown in FIG. 2, no database of template data to be applied to sections specified with legato and portamento is prepared for the note attack expression template database 220; this is because legato or portamento is not applied for utterance at the attack of a sound.

On the other hand, the note transition expression template database note transition expression template database 230 stores expression template data for use in imparting expressions to each section beginning with a note transition sound. This note transition expression template database 230 is divided into an accent template database 231, a soft template database 232, a legato template database 233, and a portamento template database 234 in accordance with the types of expression imparting. For each of the template databases in the note transition expression template database 230, template data are prepared in which first vocal element name, last vocal element name, and typical pitch form an index as shown in FIG. 4 for all combinations of a plurality of first vocal element names, a plurality of last vocal element names, and a plurality of typical pitches which are assumed beforehand.

The template data forming the expression template database 200 are applied to the sections specified with expressions such as accent, soft (gentle), legato (smooth), and portamento in the song data edit screen to be described later in detail.

A vocal element template database 240 stores vocal element template data. The vocal element template data are applied to a section in which transition between a vocal element and another takes place in the above-mentioned song score data. When a man utters two vocal elements continuously, transition between them takes place not abruptly but smoothly. For example vowel "e" is uttered after vowel "a" without a break, vowel "a" is uttered first, immediately followed by an intermediate pronunciation between both vowels and then vowel "e" is uttered. Therefore, in order to execute song synthesis such that the linkage between vocal elements is natural, it is desirable to have, in one form or another, the vocal linkage information about the possible combinations of vocal elements in a language concerned. Taking this setup into consideration, the present embodiment prepares, as template data, the variations of characteristic parameter and pitch in each section in which vocal element transition takes place and applies the prepared template data to each sound vocal transition section in the song score data, thereby realizing the vocal synthesis which is close to actual singing.

Like the above-mentioned expression template data, the vocal element template data are combinations of a sequence in which pairs of characteristic parameter P and pitch "Pitch" are arranged at every constant time and length T (sec.) of that section, which may be expressed by the above-mentioned equation (A). However, while the above-mentioned template data have a structure which has the absolute values themselves of the characteristic parameters and the pitches which vary with time, the vocal element template data have a structure which has the variations of characteristic parameter and pitch for each time. This is because there is a difference in the way of application between the expression template data and the vocal element template data, which will be described later in detail.

A state template database 250 stores state template data. The state template data are totally applied to the attack portion of each vocal element and the transition portion of each vocal element in the above-mentioned song score data. Analysis of the attack portion at the time of uttering a certain vocal element with a constant pitch indicates that the amplitude gradually increases to be stabilized at a constant level. In singing two musical notes without break, it is known that the pitch and the characteristic parameter vary with a minute undulation. Taking these facts into consideration, the present embodiment prepares, as template data, the variations of characteristic parameter and pitch in the attack section and the transition section of each vocal element and applies the prepared template data to the attack section and the transition section of each vocal element in the song score data, thereby realizing the vocal synthesis which is close to actual singing.

The state template data are also combinations of a sequence in which pairs of characteristic parameter P and pitch "Pitch" are arranged at every constant time and length T (sec.) of that section, which may be expressed by the above-mentioned equation (A). Like the above-mentioned template data, the state template data have a structure which has the variations of characteristic parameter and pitch for each time.

<Operation of the First Embodiment>

Figure 5:
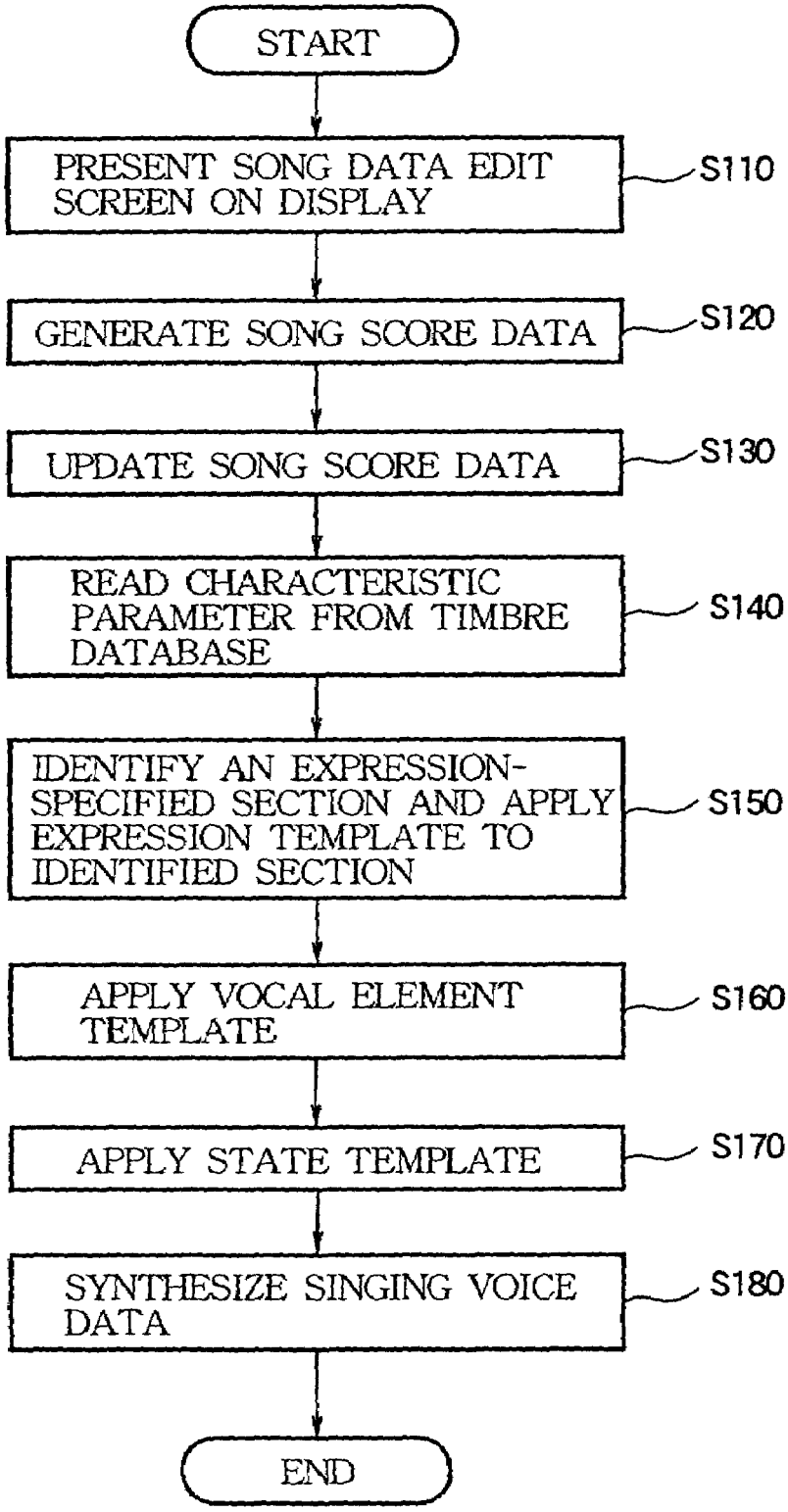
FIG. 5 is a flowchart indicative of an operation of a first embodiment.

The following describes an operation of the singing voice synthesizing apparatus having the above-mentioned configuration. Referring to FIG. 5, there is shown a flowchart indicative of the operational outline of this singing voice synthesizing apparatus.

Figure 6:
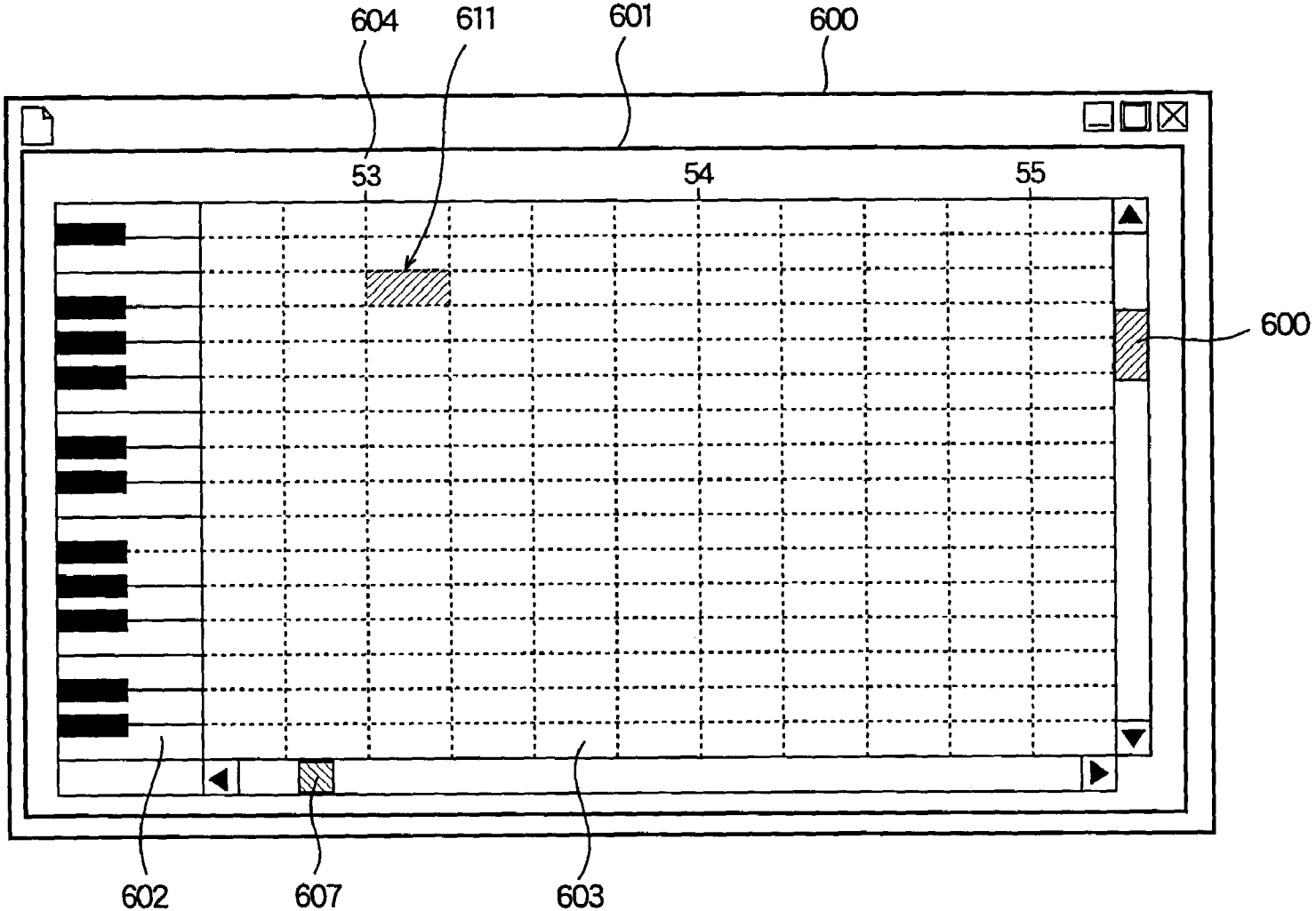
FIG. 6 is an example of a song data edit screen.

Receiving an instruction through the GUI for the execution of song synthesis, the CPU 100 reads the song synthesis program from the storage unit 200 and executes it. In the execution of this song synthesis program, the processing shown in FIG. 5 is executed. First, the interface control block 101, one of the modules forming the song synthesis program, displays a song data edit screen on the display 140 (S110). FIG. 6 shows the song data edit screen. A window 600 of the song data edit screen has an event display area 601 for showing note data in the form of a piano roll. In the right side of the event display area 601, a scroll bar 606 for vertically scrolling the display screen of the event display area 601 is arranged. In the lower side of the event display area 601, a scroll bar 607 for horizontally scrolling the display screen of the event display area 601 is arranged.

In the left side of the singing voice synthesizing block 106, a keyboard display 602 (a coordinate axis indicative of pitch) simulating the keyboard of an actual piano is displayed. In the upper side of the event display area 601, a measure display 604 indicative of the measure position from the beginning of each song is shown. Reference numeral 603 denotes a piano roll display area in which note data are shown in a long rectangle (a bar) at the time position indicated by the measure display 604 of a pitch indicated by the keyboard display 602. The left end of this bar indicates an utterance start timing, the length of the bar indicates a duration of utterance, and the right end of the bar indicates an utterance end timing.

The user moves the mouse pointer to a position on the display screen corresponding to desired pitch and time position and clicks the mouse to identify an utterance start position. Next, the user drags the bar of note data (hereafter referred to as a note bar) extending from the utterance start position to the utterance end position into the event display area 601 and then drops the note bar therein by clicking a mouse 150. For example, in order to form a note bar 611, the user moves the mouse pointer to the start position of the first beat of the 53rd measure, clicks the mouse 150, and then drags to note bar to the position one beat after.

Having formed the note bar by the above-mentioned drag and drop operations, the user enters the lyrics to be allocated to this note bar and an expression which may be specified as desired.

Figure 7:
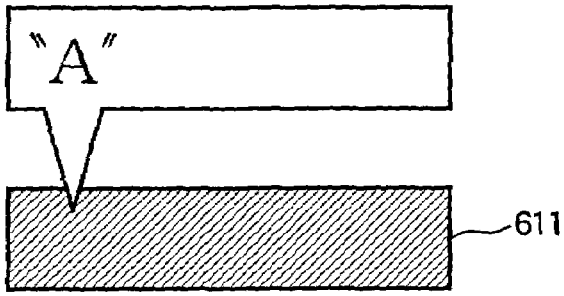
FIG. 7 is an example of a lyrics input area.

To enter the lyrics, the user moves the mouse pointer to the note bar formed as described above, clicks the right button of the mouse 150 to display a lyrics input area as shown in the expanded view shown in FIG. 7 in the upper portion of the note bar, and enters the lyrics into this input area from a keyboard 160.

Figure 8:
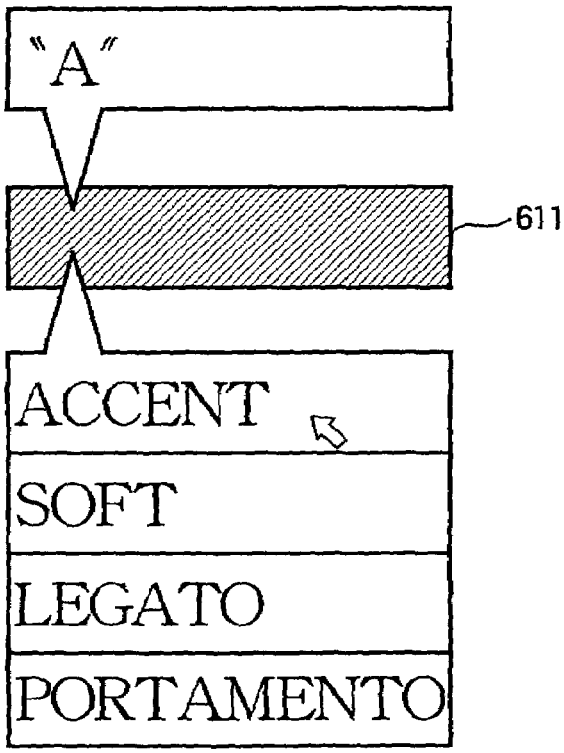
FIG. 8 is an example of a list of expressions for selection.

On the other hand, in order to enter an expression, the user moves the mouse pointer to the note bar formed as described above, clicks the left button of the mouse 150 to display an expression select list as shown in FIG. 8 in the lower portion of the note bar in a pull down manner, and selects an expression to be allocated to the note bar. The expressions shown in the expression select list are accent, soft, legato, and portamento.

Figure 9:
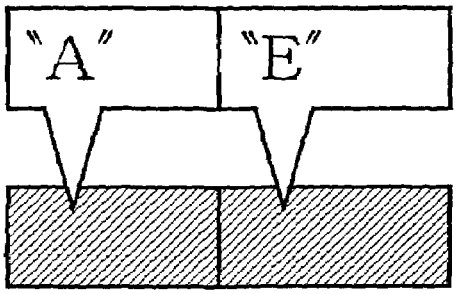
FIG. 9 is an example of inputs in a note bar.
Figure 10:
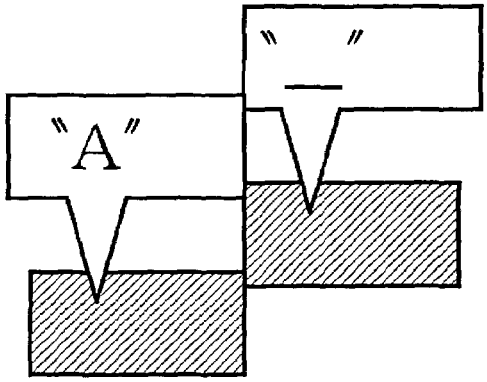
FIG. 10 is an example of inputs of lyrics.

In the case where a plurality of vocal elements are sung with the same pitch without break, the user must form a plurality of note bars of the same pitch as shown in FIG. 9 in an expanded manner. If this is not done, the user cannot understand how long the previous vocal element should be extended and from which point the following vocal element is to be uttered. In the case where a single vocal element is sung with different pitches, the user must separately form note bars having different pitches as shown in FIG. 10 in an expanded manner, enter the lyrics of the previous vocal element, and enter "-" (hyphen) as the lyrics of the following vocal element.

Having entered the note bars, lyrics, and expressions necessary for the performance of a song by executing the above-mentioned operations, the user clicks a song voice output button, not shown.

When the song voice output button is clicked, the score data generating block 102 generates song score data on the basis of the entered note data and expressions (S120).

Figure 11:
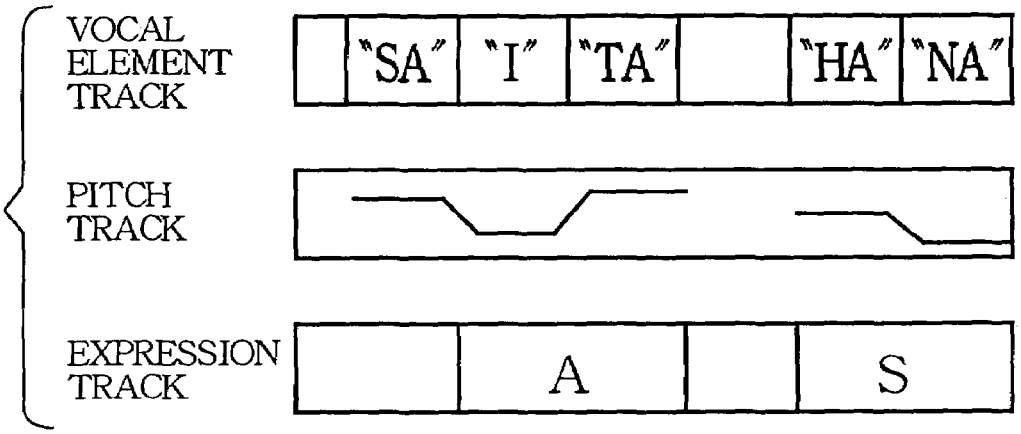
FIG. 11 is an example of song score data.

FIG. 11 is a schematic diagram illustrating one example of song score data generated by the score data generating block 102. These song score data consist of a vocal element track, a pitch track, and an expression track.

The vocal element track records the name of vocal element and the utterance sustain time of vocal element. The lyrics allocated to each note bar on the above-mentioned song data edit screen are reflected on this vocal element track.

The pitch track records the basic frequency of a vocal element to be uttered each time. The vertical coordinate of each note bar on the above-mentioned song data edit screen is reflected on the pitch track. It should be noted that the pitch of each vocal element to be actually uttered is computed by applying other information to the pitch information recorded to this pitch track, so that the pitch with which actual utterance is made may differ from the pitch recorded to this track.

The expression track records an expression specified for each particular vocal element and the sustain time of the specified expression. The expressions include "A" indicative of "accent", "S" indicative of "soft (gentle)", "R" indicative of "smooth (legato)", and "P" indicative of "portamento". For example, in the case of FIG. 11, data of "A" are recorded to the sections of vocal elements "i" and "ta" and data of "S" are recorded to the sections of vocal elements "ha" and "na". The expressions specified as desired for he note bars on the above-mentioned song data edit screen are reflected on this expression track.

On the song data edit screen, any of the expressions "accent", "soft (gentle", "legato (smooth)", and "portamento" may be specified without making distinction whether a note bar specifies the singing of a note attack note or specifies the singing of a note transition tone. Actually however, the singing of a note attack note applied with legato or portamento is unlikely. Therefore, the score data generating block 102 detects such an unlikely specification and, if such a specification is found, ignores it.

Figure 12:
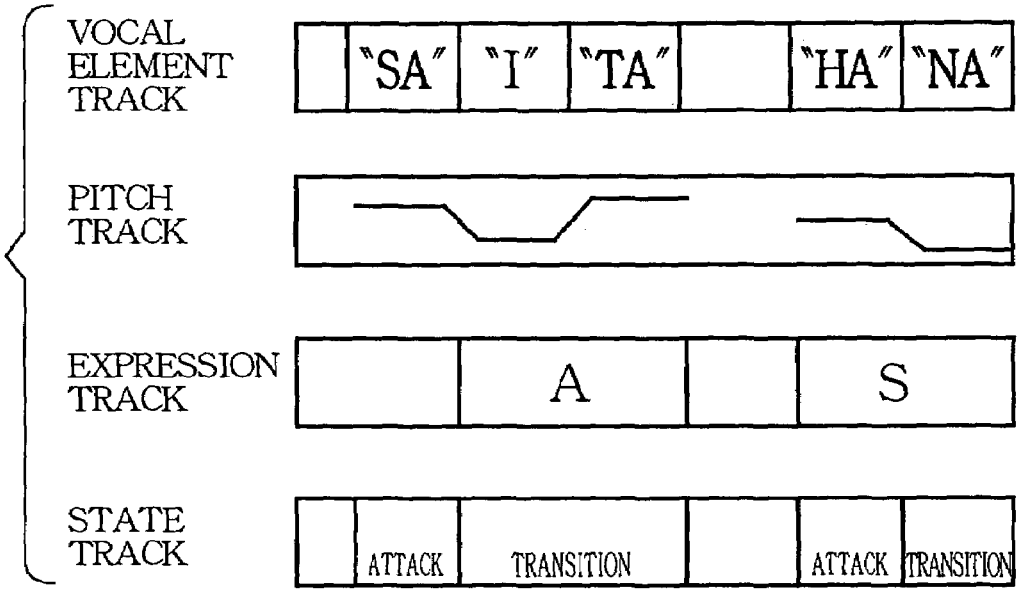
FIG. 12 is another example of song score data.

In the flowchart shown in FIG. 5, when the song score data have been generated by the score data generating block 102 (S120), then the score data updating block 103 adds data to the state track of the generated song score data to update them (S130). At this moment, the score data updating block 103 inquires the context discriminating block 104 for the context of each vocal element in the song score data. In accordance with a result of the discrimination, the context data indicative of a note attack note or the context data indicative of a note transition tone is recorded as associated with each vocal element. FIG. 12 is a schematic diagram illustrating one example of song score data with context data added to the state track. In the figure, "attack" indicative of the context data indicative of a note attack note is related with vocal elements "sa" and "ha" and "transition" indicative of the context data indicative of a note transition tone is related with vocal elements "i", "ta", and "na".

Two methods are available for discriminating contexts by the context discriminating block 104; a first method in which the vocal element track of song score data is referenced and a second method in which the pitch track of song score data is referenced.

The following describes the first discrimination method. First, from the vocal element track of song score data, the utterance timing of the vocal element immediately preceding in time the vocal element to be discriminated is identified. Next, a difference between the utterance timing of the vocal element to be discriminated and the utterance timing of the preceding vocal element. Further, if the difference is found to be within a predetermined interval, the vocal element to be discriminated is identified as a note transition tone; if the difference is found to be outside the above-mentioned predetermined interval or if no vocal element is found preceding, then the vocal element to be discriminated is identified as a note attack note.

The following describes the second discrimination method. As described above, the pitch track of song score data records the basic frequency of the voice of each vocal element to be uttered each time. Therefore, first, the start point of the vocal element to be discriminated and a time reached by tracing in time a preset predetermined interval from the start point are identified. Then, a decision is made whether there is a value for specifying a pitch in the section between the identified time and the identified start point. If the value is found in this section, the vocal element to be discriminated is determined as a note transition tone; if not, it is identified as a note attack note.

Referring to the flowchart shown in FIG. 5 again, the characteristic parameter generating block 105 extracts the information associated with the vocal element at each time t from the song score data while advancing time t, reads the characteristic parameters necessary for the synthesis of the voice waveform corresponding to this vocal element from a timbre database 210, and develops these parameters into the RAM 120 (S140). As described above, the timbre database 210 is organized with vocal element names and pitches used as its index, so that the characteristic parameters corresponding to each vocal element to be uttered may be identified by using, as a search key, each vocal element in the vocal element track of song score data and the pitch in the pitch track corresponding thereto.

The characteristic parameter generating block 105 identifies an expression-specified section on the basis of the value of the expression track at time t in the song score data and applies the expression template data read from the expression template database 200 to the characteristic parameter and pitch of this expression-specified section (S150). The following describes in detail this expression template data application processing in step S150 with reference to the flowchart shown in FIG. 13.

In step 151, the characteristic parameter generating block 105 determines whether any expression is specified in the expression track at time t. If one of "A", "S", "R", and "P" is found specified in the expression track at time t, it is determined that an expression is specified. If an expression is found specified, then the procedure goes to step 152; if not, the procedure returns to step 151 to advance time 1, thereby executing the above-mentioned processing therefrom.

In step 152, the characteristic parameter generating block 105 obtains the start time and end time of an area having the same expression attribute as the expression in the expression track at time t (for example, if the expression attribute at time t is "A" indicative of accent, then the start time and end time of this "A"). The duration between these start time and end time provides the expression-specified section to which the expression template data are applied.

In step 153, the characteristic parameter generating block 105 determines whether the data of the state track at time t are "attack" context data or "transition" context data. If "attack" context data are found recorded, the procedure goes to step 154; if "transition" context data are found recorded, the procedure goes to step 155.

In step 154, the characteristic parameter generating block 105 reads the expression template data from the note attack expression template database 220. As described above, the note attack expression template database 220 stores the accent template database 221 and the soft template database 222, each of which is organized with vocal element names and pitches used as its index. Therefore, in step 154, the database corresponding to the expression attribute of the expression track at time t is first identified (for example, the accent template database 221 if the expression attribute is "A") and then the template data corresponding to the values of the vocal element track and the pitch track at time t are identified from this database.

On the other hand, in step 155, the characteristic parameter generating block 105 reads the expression template data from the note transition expression template database 230. As described above, the note transition expression template database 230 stores the accent template database 231, the soft distortion template database 232, the legato template database 233, and the portamento template database 234, each of which is organized with first vocal element names, last vocal element names, and typical pitches used as its index. Therefore, in step 155, the database corresponding to the value of the expression track at time t (for example, in the case of "A", the accent template database 231) is identified and then the template data having an index of the vocal element at time t stored in the vocal element track (namely, the following vocal element shown in FIG. 4), the vocal element immediately preceding this vocal element (namely, the first vocal element shown in FIG. 4), and the pitch at time t recorded on the pitch track (namely, the typical pitch shown in FIG. 4) are identified from this database.

In step 156, the characteristic parameter generating block 105 expands the template data read in step 154 or step 155 to a time duration corresponding to the above-mentioned expression-specified section and exchanges the pitch and characteristic parameter in this expression-specified section with the value of the expanded template data.

Repetitive execution of the above-mentioned processing while advancing time t generates, as the performance time goes on, the characteristic parameters and pitches in accordance with the specification of expressions such as accent and legato.

Figure 13:
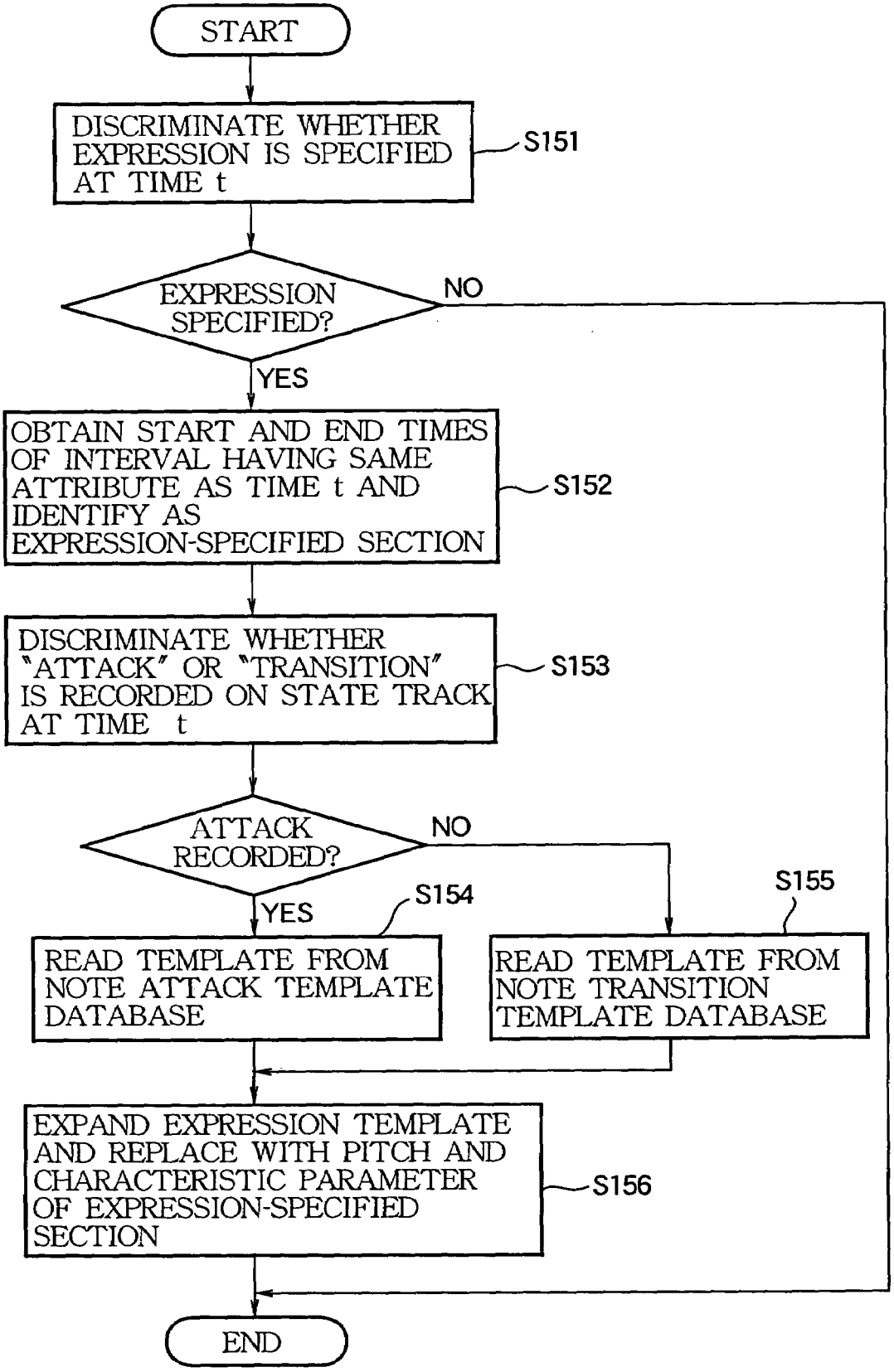
FIG. 13 is a flowchart indicative of expression template application processing.

When the above-mentioned processing shown in FIG. 13 has been completed, then, in the flowchart shown in FIG. 5, the characteristic parameter generating block 105 applies the vocal element template data read from the vocal element template database 240 to the characteristic parameter and the pitch (S160). The application of the vocal element template data is realized by identifying the vocal element transition section from the value of the vocal element track of the song score data, expanding the vocal element template data read from the vocal element template database 240 to the time duration corresponding to this transition section, and adding the value of the expanded vocal element template data to the pitch and characteristic parameter of the above-mentioned transition section. It should be note however that the above-mentioned application procedure is well known in prior-art technologies; therefore its details are skipped.

The characteristic parameter generating block 105 applies the state template data read from the state template database 250 to the characteristic parameter and the pitch (S170). The application of the state template data is realized by identifying the attack or transition section of the vocal element from the values of state track and the pitch track of the sound score data, expanding the state template data read from the state template database 250 to the time duration corresponding to the identified section, and adding the value of the expanded state template data to the pitch and characteristic parameter of the identified section. It should be note however that the above-mentioned application procedure is well known in prior-art technologies; therefore its details are skipped.

Lastly, the singing voice synthesizing block 106 synthesizes digital voice data on the basis of the characteristic parameter and pitch finally obtained as described above (S180). Then, the synthesized digital voice data are converted by the DAC 170 into the analog equivalent to be sounded from the sound system 180.

As described above, according to the first embodiment of the invention, the user who enter the data necessary for the synthesis of song data, if imparting an expression to a desired section, may only specify this expression without having to be aware of the context in which this section is placed, thereby synthesizing the proper song data suited to this context and the user-specified expression.

B: The Second Embodiment

A physical configuration of a singing voice synthesizing apparatus practiced as a second embodiment of the invention is substantially the same as that of the above-mentioned first embodiment of the invention; therefore the description of the physical configuration of the first embodiment with reference to drawings will be skipped.

Figure 14:
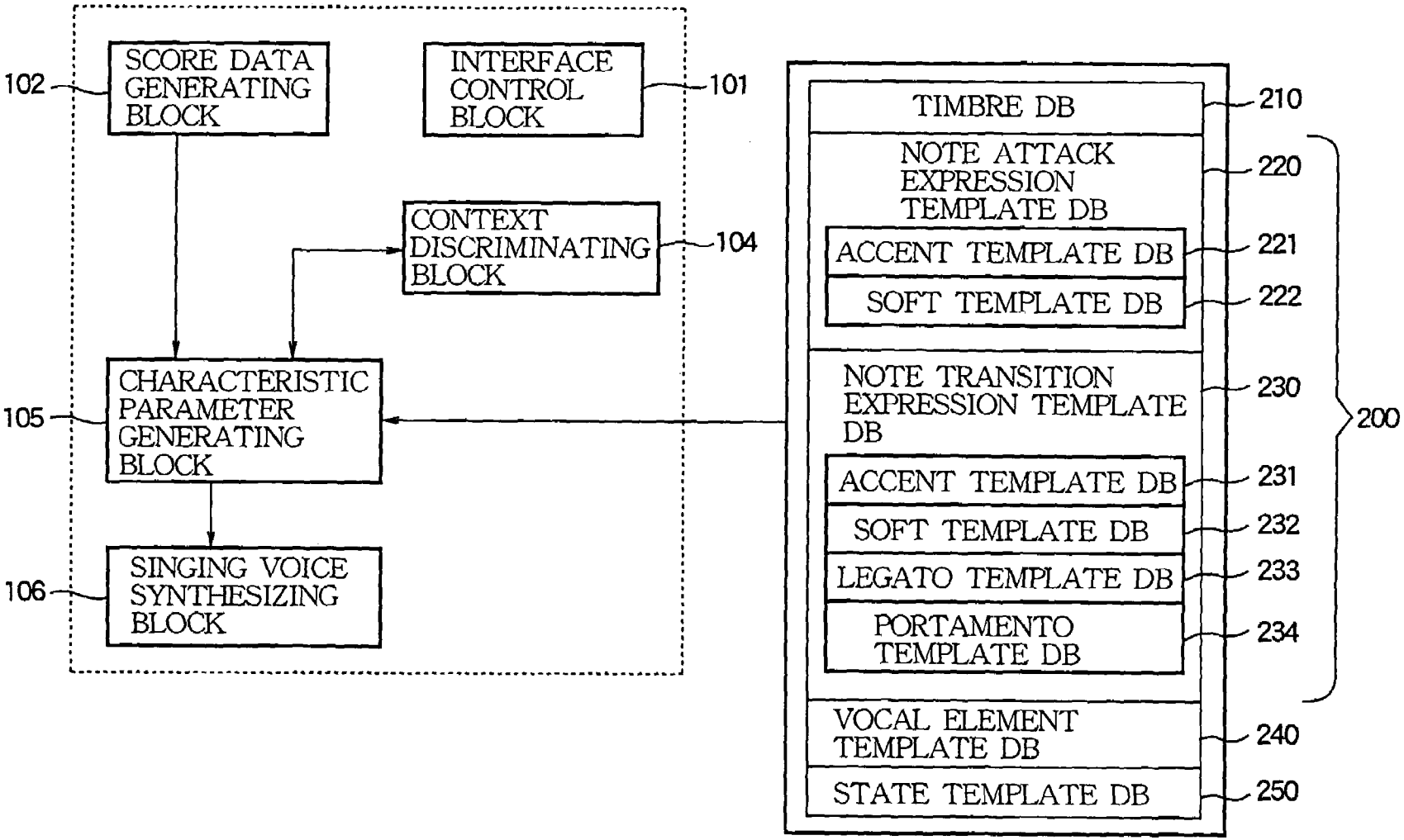
FIG. 14 is a block diagram illustrating a logical configuration of another singing voice synthesizing apparatus.

FIG. 14 is a block diagram illustrating a logical configuration of the second embodiment. On the left side of the figure, a configuration of the component blocks under the control of a CPU 100 is shown; on the right side of the figure, a configuration of databases organized into a storage unit 200 is shown.

First, executing the singing voice synthesizing program installed in the storage unit 200, the CPU 100 carries out the roles of an interface control block 101, a score data generating block 102, a context discriminating block 104, a characteristic parameter generating block 105, and a singing voice synthesizing block 106. It should be noted that the logical configuration of the second embodiment does not have the score data updating block 103 of the above-mentioned first embodiment.

The interface control block 101 is substantially the same in function as that of the first embodiment; namely it displays the song data edit screen shown in FIG. 6 onto to a display 140. The score data generating block 102 is also substantially the same in function as that of the above-mentioned first embodiment.

In response to the inquiry from the characteristic parameter generating block 105, the context discriminating block 104 in the second embodiment discriminates the context of particular vocal elements recorded in song score data. The characteristic parameter generating block 105 reads a characteristic parameter from the database and, at the same time, reads the template data corresponding to a result of the discrimination obtained by the context discriminating block 104, and applies the template data to this characteristic parameter.

The singing voice synthesizing block 106 is substantially the same in function as that of the above-mentioned first embodiment.

The organizations of the databases is also substantially the same as that of the above-mentioned first embodiment.

<Operation of the Second Embodiment>

Figure 15:
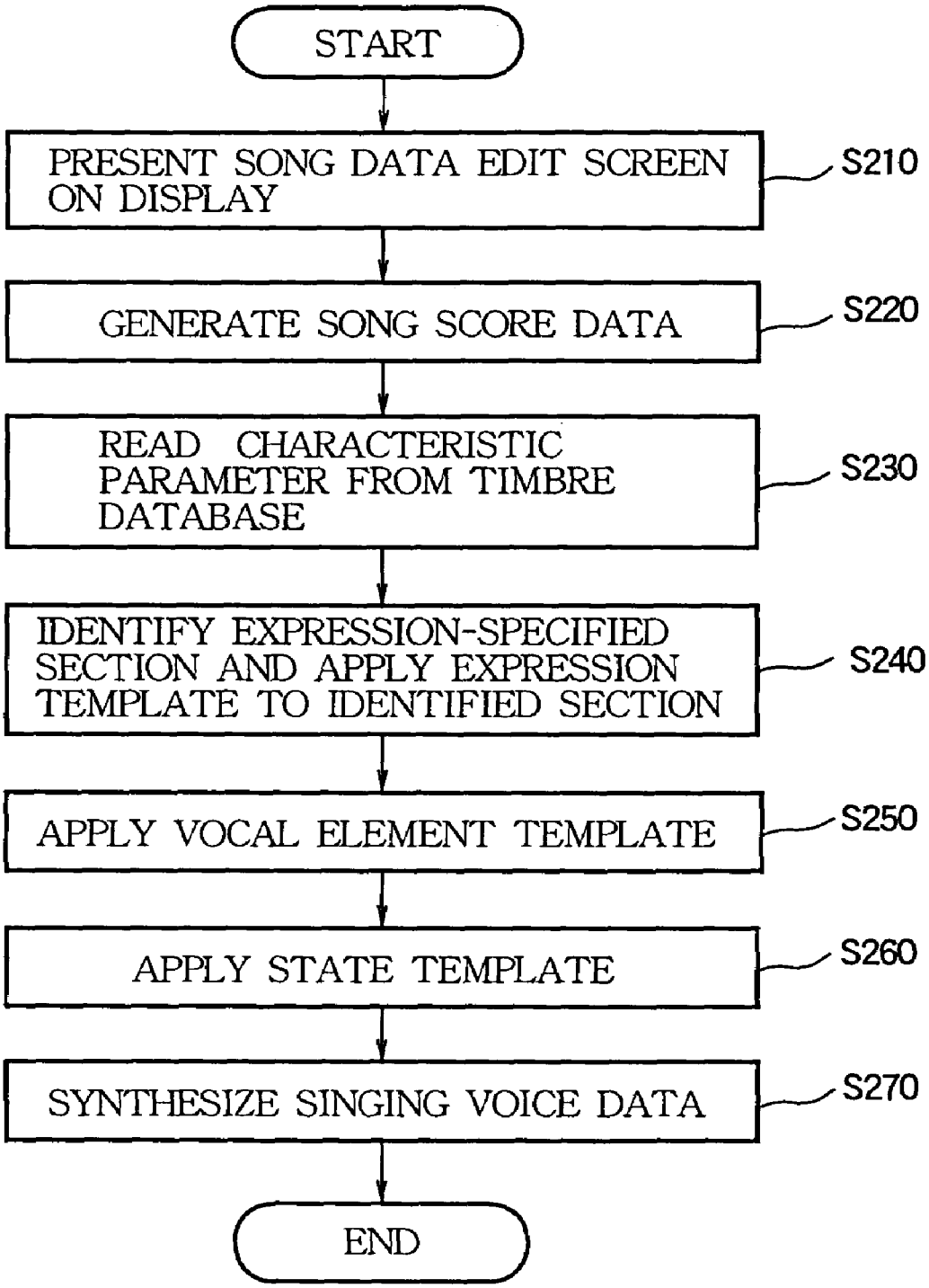
FIG. 15 is a flowchart indicative of an operation of a second embodiment.

The following describes an operation of the singing voice synthesizing apparatus having the above-mentioned configuration. FIG. 15 is a flowchart indicative of an operational outline of the singing voice synthesizing apparatus of the second embodiment.

Receiving an instruction through the GUI for the execution of song synthesis, the CPU 100 reads the song synthesis program from the storage unit 200 and executes it. In the execution of this song synthesis program, the processing shown in FIG. 15 is executed. In FIG. 15, the processing of steps S210 through S220 and the processing of steps S240 through S270 are substantially the same as those of steps S110 through S120 and steps S150 through S180 in FIG. 5 of the above-mentioned first embodiment. In the processing shown in FIG. 5, the update processing for adding the state track data to the song score data is executed in step S130. However, the processing shown in FIG. 15 has no processing equivalent to this update processing of step S130. Instead, the processing to be executed in step S230 of FIG. 15 is that shown in FIG. 16 rather than FIG. 13. This is the difference between the first embodiment and the second embodiment.

Figure 16:
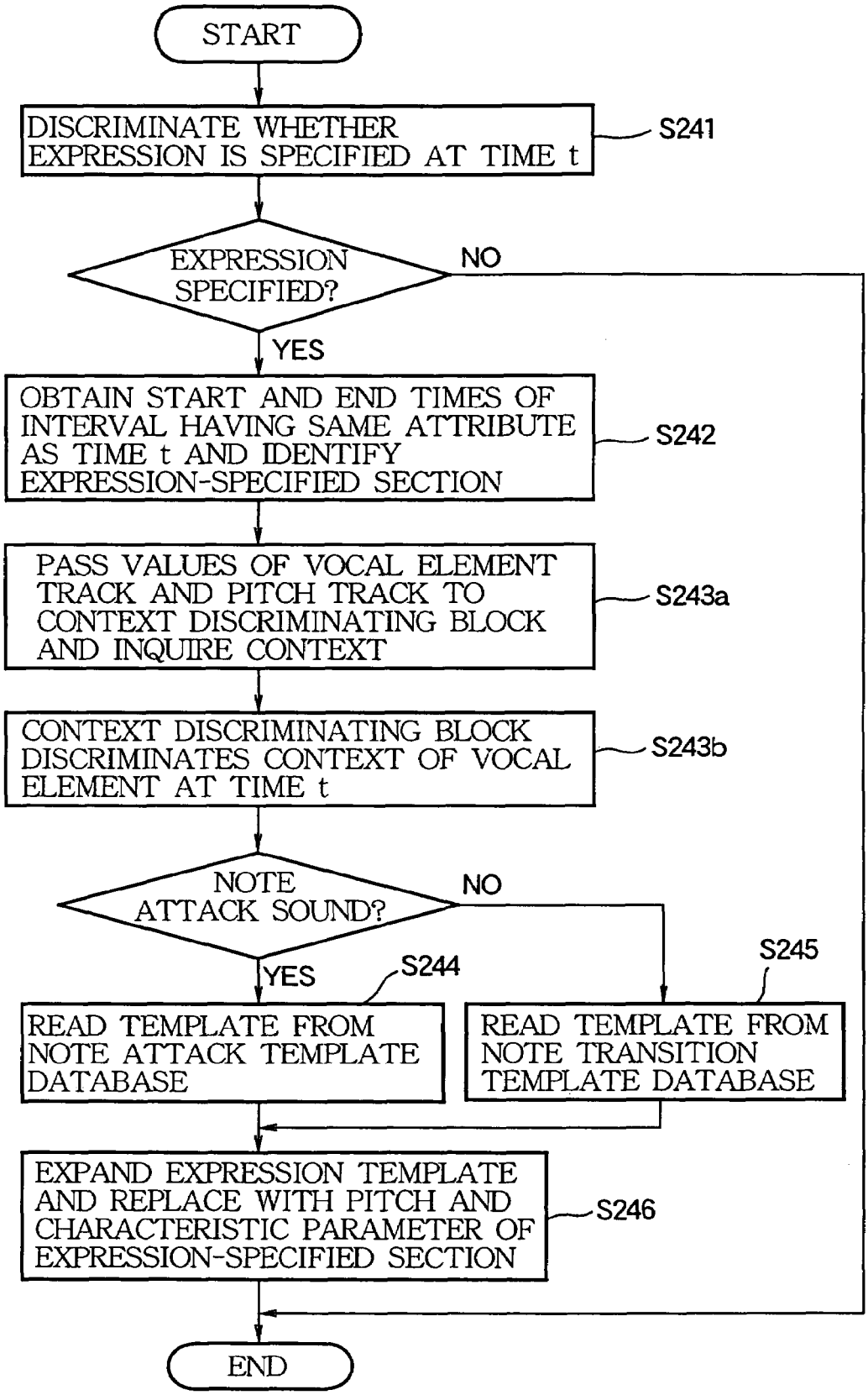
FIG. 16 is a flowchart indicative of expression template application processing.

In FIG. 16, the processing of steps S241 and S242 and the processing of steps S244 through S246 are substantially the same as those of steps S151 and S152 and steps S154 through S156. In FIG. 16, step S153 in FIG. 13 is replaced by steps S243*a* and S243*b*. Therefore, only steps S243*a* and S243*b* will be described to avoid the duplication of description.

First, in step 243*a*, the characteristic parameter generating block 105 extracts the data belonging to a constant period of time ending with time t from the vocal element track and the pitch track of the song score data and passes the extracted data to the context discriminating block 104 to inquire for the context of the vocal element at time t.

In step 243*b*, on the basis of the data supplied from the characteristic parameter generating block 105, the context discriminating block 104 discriminates the context of the vocal element at time t. If this vocal element is found by the context discriminating block 104 to be a note attack note, then the procedure goes to step 244; if this vocal element is found to be a note transition tone, then the procedure goes to step 245.

The second embodiment described above differs from the above-mentioned first embodiment in the timing of the discrimination of the context of each vocal element recorded in song score data. In the above-mentioned first embodiment, the context of each vocal element at it is before the parameter generating operation is started is discriminated and, in accordance with a result of this discrimination, the context data "attack" or "Transition" are recorded into the song score data. In the second embodiment, the characteristic parameter generating block 105 gets the song score data which have no data for identifying the context of each vocal element. Then, when the characteristic parameter generating block 105 reads the template data from the database, the context of each vocal element is discriminated. The second embodiment having this configuration has no necessity for providing the state track in song score data, thereby reducing the capacity for song score data.

C: Variations

While the preferred embodiments of the present invention have been described using specific terms, such description is for illustrative purposes only, and it is to be understood that changes and variations may be made. For example, variations described below are possible.

<C-1: Variation 1>

In each of the above-mentioned embodiments of the invention, one of the expressions "accent", "soft (gentle)", "legato (smooth)", and "portamento" is specified for each note bar and this specification may be made regardless of the note bar which specifies the singing of note attack notes or the singing of note transition tones. In addition, such a specification as is unlikely in the actual singing, the application of legato expression to a note attack note for example, is detected at the time of generating score data or generating characteristic parameters and, if such a specification is detected, it is ignored.

Figure 17:
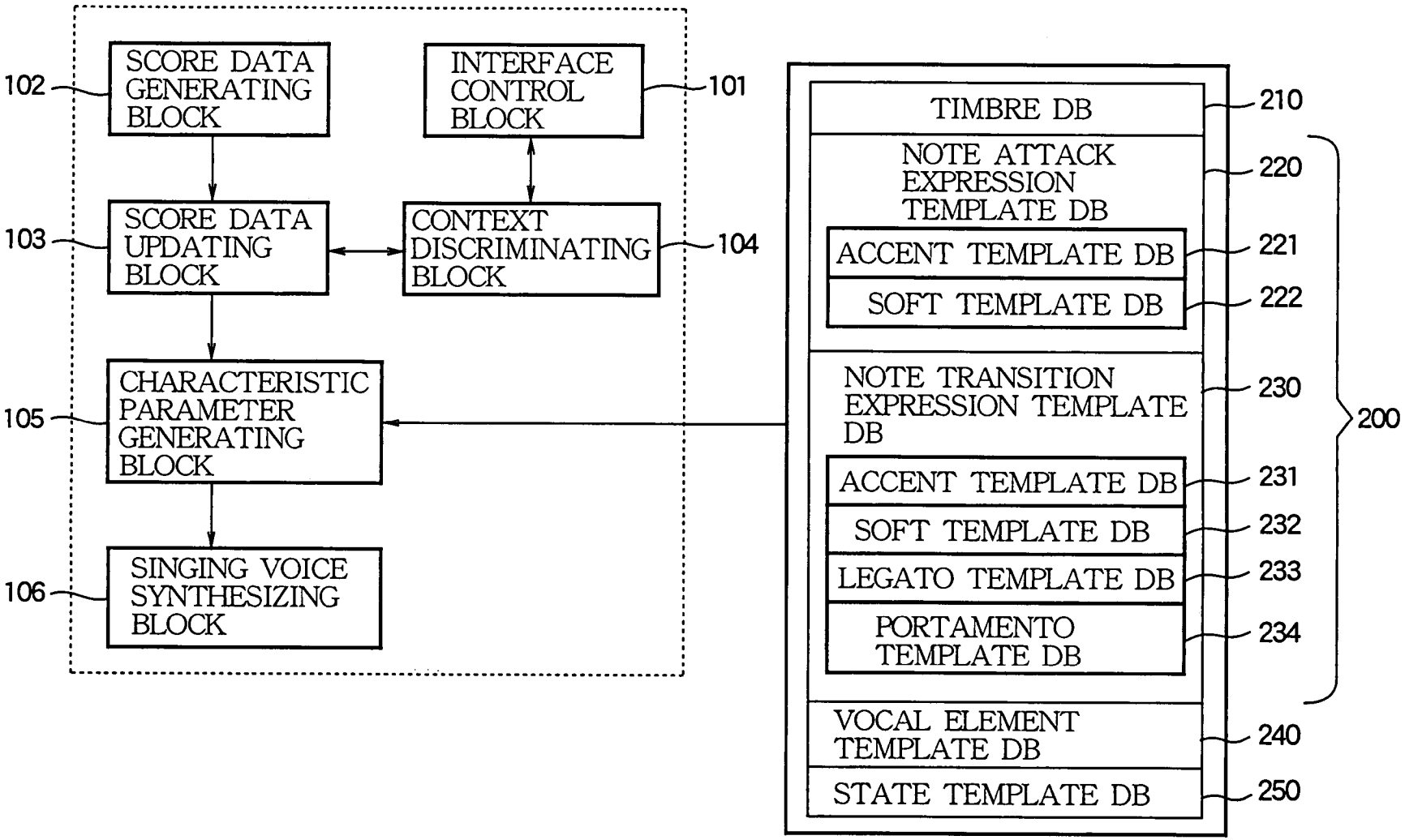
FIG. 17 is a block diagram illustrating a logical configuration of still another singing voice synthesizing apparatus.

Alternatively, a logical configuration as shown in FIG. 17 may be employed in which any user's operation for making the above-mentioned specification which is unlikely in actual singing is prevented by the interface control block 101 from being done through the above-mentioned song data edit screen. For this input operation preventing method, the following may be proposed. First, when the specification for an expression for a note bar formed on the above-mentioned song data edit screen is entered, the interface control block 101 inquires the context discriminating block 104 whether this note bar is for the singing of a note attack note or a note transition tone. If the note bar is found to be the specification for the singing of a note attack note, the interface control block 101 displays message "This note is an attack note, so that you cannot apply legato or portamento to this note."

<C-2: Variation 2>

In each of the above-mentioned embodiments of the invention, the song score data are formed by three tracks of vocal element, pitch, and expression or four tracks of vocal element, pitch, expression, and state. Another configuration may be provided. For example, a track for recording a dynamics value at each time which is a parameter indicative of the intensity of voice and a track for recording an opening value at each time which is a parameter indicative of lip opening may be added to the above-mentioned tracks, thereby reproducing singing tones closer to actual human voices.

As described and according to the invention, the singing voice synthesizing apparatus has discriminating means for discriminating whether each vocal element included in voice information is an attack note or a non-attack note and separately prepares the template data to be applied to the attack note and the template data to be applied to the non-attack note. When voice information is entered, the template data to be applied to the entered voice information are automatically identified in accordance with the decision made by the above-mentioned discriminating means. This novel configuration allows the user to easily generate voice information for the synthesis of voices attached with expressions without having to be aware of whether each vocal element is an attack note or a non-attack note.

What is claimed is:

1. An apparatus for synthesizing a singing voice of a song, comprising:

a storage section that stores template data in correspondence to various expressions applicable to music notes including an attack note and a non-attack note, the template data including first template data defining a temporal variation of a characteristic parameter for applying the corresponding expression to the attack note and second template data defining a temporal variation of a characteristic parameter for applying the corresponding expression to the non-attack note;

an input section that inputs voice information representing a sequence of vocal elements forming lyrics of the song and specifying expressions in correspondence to the respective vocal elements, wherein the input section inputs the voice information containing timing information, which specifies utterance timings of the respective vocal elements along a progression of the song;

a synthesizing section that synthesizes the singing voice of the lyrics from the sequence of the vocal elements based on the input voice information, such that the synthesizing section operates when the vocal element is of an attack note for retrieving the first template data corresponding to the expression specified to the vocal element and applying the specified expression to the vocal element of the attack note according to the retrieved first template data, and operates when the vocal element is of a non-attack note for retrieving the second template data corresponding to the expression specified to the vocal element and applying the specified expression to the vocal element of the non-attack note according to the retrieved second template data; and a discriminating section that discriminates the respective vocal elements to either of the non-attack note or the attack note based on the utterance timings of the respective vocal elements, such that the vocal element is identified to the non-attack note when the vocal element has a preceding vocal element, which is uttered before the vocal element, and when a difference of the utterance timings between the vocal element and the preceding vocal element is within a predetermined time length, and otherwise the vocal element is identified to the attack note when the vocal element has no preceding vocal element or has a preceding vocal element but the difference of utterance timings between the vocal element and the preceding vocal element exceeds the predetermined time length.

2. The apparatus according to claim 1, wherein the discriminating section discriminates each vocal element to either of the non-attack note or the attack note based on the input voice information in real time basis during the course of synthesizing the singing voice of the song.

3. The apparatus according to claim 1, wherein the input section inputs the voice information in the form of a vocal element track and an expression track, the vocal element track recording the vocal elements integrally with the timing information such that the respective vocal elements are sequentially arranged along the vocal element track in a temporal order determined by the respective utterance timings, the expression track recording the expressions corresponding to the vocal elements in synchronization with the vocal element track.

4. An apparatus for synthesizing a singing voice of a song, comprising:

a storage section that stores template data in correspondence to various expressions applicable to music notes including an attack note and a non-attack note, the template data including first template data defining a temporal variation of a characteristic parameter for applying the corresponding expression to the attack note and second template data defining a temporal variation of a characteristic parameter for applying the corresponding expression to the non-attack note;

an input section that inputs voice information representing a sequence of vocal elements forming lyrics of the song and specifying expressions in correspondence to the respective vocal elements, wherein the input section inputs the voice information containing pitch information, which represents a transition of a pitch applied to each vocal element in association with an utterance timing of each vocal element;

a synthesizing section that synthesizes the singing voice of the lyrics from the sequence of the vocal elements based on the input voice information, such that the synthesizing section operates when the vocal element is of an attack note for retrieving the first template data corresponding to the expression specified to the vocal element and applying the specified expression to the vocal element of the attack note according to the retrieved first template data, and operates when the vocal element is of a non-attack note for retrieving the second template data corresponding to the expression specified to the vocal element and applying the specified expression to the vocal element of the non-attack note according to the retrieved second template data; and discriminating section that discriminates each vocal element to either of the non-attack note or the attack note based on the pitch information, such that the vocal element is identified to the non-attack note when a value of the pitch is found in a preceding time slot extending back from the utterance timing of the vocal element by a predetermined time length, and otherwise the vocal element is identified to the attack note when a value of the pitch is not found in the preceding time slot.

5. The apparatus according to claim 4, wherein the input section inputs the voice information in the form of a vocal element track, a pitch track, and an expression track, the vocal element track recording the sequence of the respective vocal elements in a temporal order determined by the respective utterance timings, the pitch track recording the transition of the pitch applied to each vocal element in synchronization with the vocal element track, the expression track recording the expressions corresponding to the vocal elements in synchronization with the vocal element track.

6. The apparatus according to claim 4, wherein the discriminating section discriminates each vocal element to either of the non-attack note or the attack note based on the input voice information in real time basis during the course of synthesizing the singing voice of the song.

7. A computer-readable medium storing a computer program for synthesizing a singing voice of a song with template data stored in a storage correspondingly to various expressions applicable to music notes including an attack note and a non-attack note, the template data including first template data defining a temporal variation of a characteristic parameter for applying the corresponding expression to the attack note and second template data defining a temporal variation of a characteristic parameter for applying the corresponding expression to the non-attack note, the program comprising instructions for:

inputting voice information which represents a sequence of vocal elements forming lyrics of the song and which specifies expressions in correspondence to the respective vocal elements, wherein the inputting instruction includes inputting the voice information containing timing information, which specifies utterance timings of the respective vocal elements along a progression of the song;

synthesizing the singing voice of the lyrics from the sequence of the vocal elements based on the input voice information when the vocal element is of an attack note such that the first template data corresponding to the expression specified to the vocal element is retrieved from the storage and the specified expression is applied to the vocal element of the attack note according to the retrieved first template data, and when the vocal element is of a non-attack note such that the second template data corresponding to the expression specified to the vocal element is retrieved from the storage and the specified expression is applied to the vocal element of the non-attack note according to the retrieved second template data; and discriminating the respective vocal elements to either of the non-attack note or the attack note based on the utterance timings of the respective vocal elements, such that the vocal element is identified to the non-attack note when the vocal element has a preceding vocal element, which is uttered before the vocal element, and when a difference of the utterance timings between the vocal element and the preceding vocal element is within a predetermined time length, and otherwise the vocal element is identified to the attack note when the vocal element has no preceding vocal element or has a preceding vocal element but the difference of utterance timings between the vocal element and the preceding vocal element exceeds the predetermined time length.

8. The computer-readable medium according to claim 7, wherein the discriminating instruction discriminates each vocal element to either of the non-attack note or the attack note based on the input voice information in real time basis during the course of synthesizing the singing voice of the song.

9. The computer-readable medium according to claim 7, wherein the inputting instruction includes inputting the voice information in the form of a vocal element track and an expression track, the vocal element track recording the vocal elements integrally with the timing information such that the respective vocal elements are sequentially arranged along the vocal element track in a temporal order determined by the respective utterance timings, the expression track recording the expressions corresponding to the vocal elements in synchronization with the vocal element track.

10. A computer-readable medium storing a computer program for synthesizing a singing voice of a song with template data stored in a storage correspondingly to various expressions applicable to music notes including an attack note and a non-attack note, the template data including first template data defining a temporal variation of a characteristic parameter for applying the corresponding expression to the attack note and second template data defining a temporal variation of a characteristic parameter for applying the corresponding expression to the non-attack note, the program comprising instructions for:

inputting voice information which represents a sequence of vocal elements forming lyrics of the song and which specifies expressions in correspondence to the respective vocal elements, wherein the inputting instruction includes inputting the voice information containing pitch information, which represents a transition of a pitch applied to each vocal element in association with an utterance timing of each vocal element;

synthesizing the singing voice of the lyrics from the sequence of the vocal elements based on the input voice information when the vocal element is of an attack note such that the first template data corresponding to the expression specified to the vocal element is retrieved from the storage and the specified expression is applied to the vocal element of the attack note according to the retrieved first template data, and when the vocal element is of a non-attack note such that the second template data corresponding to the expression specified to the vocal element is retrieved from the storage and the specified expression is applied to the vocal element of the non-attack note according to the retrieved second template data; and discriminating each vocal element to either of the non-attack note or the attack note based on the pitch information, such that the vocal element is identified to the non-attack note when a value of the pitch is found in a preceding time slot extending back from the utterance timing of the vocal element by a predetermined time length, and otherwise the vocal element is identified to the attack note when a value of the pitch is not found in the preceding time slot.

11. The computer-readable medium according to claim 10, wherein the inputting instruction includes inputting the voice information in the form of a vocal element track, a pitch track, and an expression track, the vocal element track recording the sequence of the respective vocal elements in a temporal order determined by the respective utterance timings, the pitch track recording the transition of the pitch applied to each vocal element in synchronization with the vocal element track, and the expression track recording the expressions corresponding to the vocal elements in synchronization with the vocal element track.

12. The computer-readable medium according to claim 10, wherein the discriminating instruction discriminates each vocal element to either of the non-attack note or the attack note based on the input voice information in real time basis during the course of synthesizing the singing voice of the song.

13. A method of synthesizing a singing voice of a song, comprising:

a step of storing template data in a storage correspondingly to various expressions applicable to music notes including an attack note and a non-attack note, the template data including first template data defining a temporal variation of a characteristic parameter for applying the corresponding expression to the attack note and second template data defining a temporal variation of a characteristic parameter for applying the corresponding expression to the non-attack note;

a step of inputting voice information, which represents a sequence of vocal elements forming lyrics of the song and specifies expressions in correspondence to the respective vocal elements, wherein the inputting step includes inputting the voice information containing timing information, which specifies utterance timings of the respective vocal elements along a progression of the song;

a step of synthesizing the singing voice of the lyrics from the sequence of the vocal elements based on the input voice information when the vocal element is of an attack note such that the first template data corresponding to the expression specified to the vocal element is retrieved from the storage and the specified expression is applied to the vocal element of the attack note according to the retrieved first template data, and when the vocal element is of a non-attack note such that the second template data corresponding to the expression specified to the vocal element is retrieved from the storage and the specified expression is applied to the vocal element of the non-attack note according to the retrieved second template date; and a step of discriminating the respective vocal elements to either of the non-attack note or the attack note based on the utterance timings of the respective vocal elements, such that the vocal element is identified to the non-attack note when the vocal element has a preceding vocal element, which is uttered before the vocal element, and when a difference of the utterance timings between the vocal element and the preceding vocal element is within a predetermined time length, and otherwise the vocal element is identified to the attack note when the vocal element has no preceding vocal element or has a preceding vocal element but the difference of utterance timings between the vocal element and the preceding vocal element exceeds the predetermined time length.

14. The method according to claim 13, wherein the discriminating step discriminates each vocal element to either of the non-attack note or the attack note based on the input voice information in real time basis during the course of synthesizing the singing voice of the song.

15. A method of synthesizing a singing voice of a song, comprising:

a step of storing template data in a storage correspondingly to various expressions applicable to music notes including an attack note and a non-attack note, the template data including first template data defining a temporal variation of a characteristic parameter for applying the corresponding expression to the attack note and second template data defining a temporal variation of a characteristic parameter for applying the corresponding expression to the non-attack note;

a step of inputting voice information, which represents a sequence of vocal elements forming lyrics of the song and specifies expressions in correspondence to the respective vocal elements, wherein the inputting step includes inputting the voice information containing pitch information, which represents a transition of a pitch applied to each vocal element in association with an utterance timing of each vocal element;

a step of synthesizing the singing voice of the lyrics from the sequence of the vocal elements based on the input voice information when the vocal element is of an attack note such that the first template data corresponding to the expression specified to the vocal element is retrieved from the storage and the specified expression is applied to the vocal element of the attack note according to the retrieved first template data, and when the vocal element is of a non-attack note such that the second template data corresponding to the expression specified to the vocal element is retrieved from the storage and the specified expression is applied to the vocal element of the non-attack note according to the retrieved second template data; and a step of discriminating each vocal element to either of the non-attack note or the attack note based on the pitch information, such that the vocal element is identified to the non-attack note when a value of the pitch is found in a preceding time slot extending back from the utterance timing of the vocal element by a predetermined time length, and otherwise the vocal element is identified to the attack note when a value of the pitch is not found in the preceding time slot.

16. The method according to claim 15, wherein the discriminating step discriminates each vocal element to either of the non-attack note or the attack note based on the input voice information in real time basis during the course of synthesizing the singing voice of the song.

* * * * *